US007363729B2

(12) United States Patent
Tanaka et al.

(10) Patent No.: US 7,363,729 B2
(45) Date of Patent: Apr. 29, 2008

(54) MANUFACTURING METHOD OF OPTICAL FILM, AND OPTICAL FILM

(75) Inventors: Takeshi Tanaka, Kobe (JP); Takashi Murakami, Hachioji (JP)

(73) Assignee: Konica Minolta Opto, Inc., Tokyo (JP)

( * ) Notice: Subject to any disclaimer, the term of this patent is extended or adjusted under 35 U.S.C. 154(b) by 0 days.

(21) Appl. No.: 11/385,752

(22) Filed: Mar. 22, 2006

(65) Prior Publication Data

US 2006/0213077 A1 Sep. 28, 2006

(30) Foreign Application Priority Data

Mar. 28, 2005 (JP) ..... 2005-092439
Feb. 13, 2006 (JP) ..... 2006-034891

(51) Int. Cl.
*F26B 5/04* (2006.01)

(52) U.S. Cl. ..... 34/418; 205/333; 399/140

(58) Field of Classification Search ..... 34/418; 399/140; 205/333; 252/299.01
See application file for complete search history.

(56) References Cited

U.S. PATENT DOCUMENTS 3,944,357 A * 3/1976 Wacks ..... 399/140
4,143,468 A * 3/1979 Novotny et al. ..... 34/276
4,409,285 A * 10/1983 Swerdlow ..... 428/332
6,780,965 B2 * 8/2004 Ando et al. ..... 528/481

* cited by examiner

*Primary Examiner*—S. Gravini
(74) *Attorney, Agent, or Firm*—Finnegan, Henderson, Farabow, Garrett & Dunner, L.L.P.

(57) ABSTRACT

A washing process to sufficiently remove contaminants attached on the surface of an optical film is proposed. Specifically, disclosed is a method of manufacturing an optical film, wherein the method possesses the steps of spraying onto at least one surface of a transparent film a solidified blast material via cooling that is a gas or a liquid at normal temperature and pressure, washing the at least one surface of the transparent film, and coating at least one optically functional layer on the washed surface of the transparent film.

16 Claims, 5 Drawing Sheets

FIG. 4(a)

| | CONTAMINANT REMOVING PROCESS | CONDITIONS | CONTAMINANT TROUBLE | DAMAGE | FLATNESS |
|---|---|---|---|---|---|
| Example 1 | DRY ICE BLAST | A | 7 / cm² | A | B |
| Example 2 | DRY ICE BLAST | B | 4 / cm² | A | A |
| Example 3 | DRY ICE BLAST | C | 0 / cm² | A | A |
| Example 4 | DRY ICE BLAST | D | 3 / cm² | A | A |
| Example 5 | DRY ICE BLAST | E | 1 / cm² | A | A |
| Example 6 | DRY ICE BLAST | F | 0 / cm² | A | A |
| Example 7 | DRY ICE BLAST | G | 0 / cm² | A | A |
| Example 8 | DRY ICE BLAST | H | 1 / cm² | A | A |
| Example 9 | DRY ICE BLAST | I | 1 / cm² | A | B |
| | | | | | |
| Comparative example 1 | ADHESION TYPE | - | 15 / cm | B | D |
| Comparative example 2 | BRUSH TYPE HEAVY RUBBING | - | 32 / cm² | D | C |
| Comparative example 3 | NO REMOVING PROCESS CONDUCTED | - | 48 / cm² | A | A |

Examples 1 - 9 : EXAMPLE (THE DRY ICE BLAST MATERIAL IS SPRAYED TO A RESIN FILM SUBSTRATE TO REMOVE THE DEPOSITS, AND A HARD COAT LAYER IS FORMED THEREAFTER.)
Comparative example 1 : CONTAMINANTS ARE REMOVED FROM THE RESIN FILM SUBSTRATE BY AN ADHESION WEB CLEANER, AND A HARD COAT LAYER IS FORMED THEREAFTER
Comparative example 2 : THE SURFACE OF THE RESIN FILM SUBSTRATE IS RUBBED HEAVILY BY A BRUSH TYPE WEB CLEANER, AND A HARD COAT LAYER IS FORMED THEREAFTER
Comparative example 3 : WITHOUT CONTAMINANT REMOVAL PROCESS

FIG. 4(b)

| CONDITIONS | BLAST MATERIAL | ROLLER MEMBER | ROLLER MEMBER TEMPERATURE | ATMOSPHERIC TEMPERATURE | SUPPORT MEMBER TEMPERATURE | ATMOSPHERIC DEW POINT | DISCHARGING DEVICE | OTHERS |
|---|---|---|---|---|---|---|---|---|
| A | DRY ICE BLAST | | - | 20℃ | 20℃ | <0℃ | NOT PROVIDE | OPEN |
| B | DRY ICE BLAST | φ100mm | 20℃ | 20℃ | 20℃ | <0℃ | PROVIDE | OPEN |
| C | DRY ICE BLAST | φ100mm | 20℃ | 20℃ | 20℃ | <0℃ | PROVIDE | SUCTION |
| D | DRY ICE BLAST | φ500mm | 10℃ | 20℃ | 20℃ | <0℃ | PROVIDE | SUCTION |
| E | DRY ICE BLAST | φ500mm | 30℃ | 30℃ | 30℃ | <0℃ | PROVIDE | SUCTION |
| F | DRY ICE BLAST | φ1000mm | 50℃ | 50℃ | 50℃ | <0℃ | PROVIDE | SUCTION |
| G | DRY ICE BLAST | φ500mm | 60℃ | 60℃ | 60℃ | <0℃ | PROVIDE | SUCTION |
| H | DRY ICE BLAST | φ500mm | 80℃ | 60℃ | 60℃ | <0℃ | PROVIDE | SUCTION |
| I | DRY ICE BLAST | φ500mm | 120℃ | 60℃ | 80℃ | <0℃ | PROVIDE | SUCTION |

FIG. 5

| | CONTAMINANT REMOVING PROCESS | CONDITIONS | TIMING OF REMOVING CONTAMINANTS | CONTAMINANT TROUBLE | VARIATIONS IN SCRATCH RESISTANCE | FLATNESS |
|---|---|---|---|---|---|---|
| Example 1 | DRY ICE BLAST | E | S2 | 6 / cm² | A | A |
| Example 2 | DRY ICE BLAST PLUS AIR TYPE WEB CLEANER | E | S2 | 3 / cm² | A | A |
| Example 3 | DRY ICE BLAST PLUS AIR TYPE WEB CLEANER | E | S1 AND S2 | 0 / cm² | A | A |
| Example 4 | DRY ICE BLAST PLUS ADHESION TYPE WEB CLEANER | E | S2 | 1 / cm² | A | A |
| Example 5 | DRY ICE BLAST PLUS BRUSH TYPE WEB CLEANER | E | S2 | 2 / cm² | A | A |
| | | | | | | |
| Comparative example 1 | ADHESION TYPE WEB CLEANER D | - | S2 | 31 / cm² | D | D |
| Comparative example 2 | BRUSH TYPE WEB CLEANER | HEAVY RUBBING | S2 | 57 / cm² | D | C |
| Comparative example 3 | NO REMOVING PROCESS CONDUCTED | - | - | 98 / cm² | C | A |

TIMING OF REMOVING THE CONTAMINANTS,
S1 : REMOVE CONTAMINANTS FROM THE RESIN FILM SUBSTRATE PRIOR TO COATING OF THE HARD COAT LAYER
S2 : REMOVE CONTAMINANTS FROM THE OPTICAL FILM PRIOR TO COATING OF THE ANTIREFLECTION LAYER AFTER FORMATION OF THE HARD COAT LAYER

MANUFACTURING METHOD OF OPTICAL FILM, AND OPTICAL FILM

This application claims priority from Japanese Patent Application No. 2005-092439 filed on Mar. 28, 2005 and Japanese Patent Application No. 2006-034891 filed on Feb. 13, 2006 which are incorporated hereinto by reference.

TECHNICAL FIELD

The present invention relates to an optical film which is suitably placed on an image plane of each of display devices as represented by a plasma display, an EL display, a CRT, and the like, and to a manufacturing method thereof.

BACKGROUND

Large-sizing and high definition of the screen for various displays such as a liquid crystal display, a plasma display and so forth have been advanced, and the visibility and handling to be improved are demanded. In order to improve these, optical films exhibiting various optical functions are proposed. Specific examples of the optical film include an anti-reflection film, an anti-glare film, a hard coat film, an anti-stain film, an anti-static film a view-angle improving film, a phase difference film, a polarizing plate protective film, an optical compensating film, a luminance enhancing film, and a light diffusion film. These films tend to be desired to have at least two kinds of functions at the same time.

On the other hand, large-sizing of various displays such as a flat panel display, and so forth, accompanied simultaneously with demand of manufacturing cost reduction has also been advanced. Though a highly advanced technique is desired to produce the above optical films, more uniform quality besides this is demanded than before in order to correspond to large-sizing of the displays.

The aforementioned optical film is manufactured by casting and drying of the resin dissolved in the solvent and molten resin. Many processes such as casting, orientation, coating, drying, surface treatment, heat treatment and winding processes are required to manufacture the aforementioned optical film. It has been required to remove such contaminants as the dust and resin film fragments deposited on the film in these processes.

To remove the contaminants on the optical film, proposals have been submitted to disclose a means for removing the contaminants, such as an adhesion type web cleaner (e.g. Patent Documents 1 and 2), brush type cleaner (e.g. Patent Document 3) and air type web cleaner (e.g. Patent Document 4), in addition to the methods of performing the entire manufacturing processes in a clean room.

[Patent Document 1] Japanese Patent O.P.I. Publication No. 2002-334429

[Patent Document 2] Japanese Patent O.P.I. Publication No. 2004-189967

[Patent Document 3] Japanese Patent O.P.I. Publication No. 10-309541

[Patent Document 4] Japanese Patent O.P.I. Publication No. 7-68226

SUMMARY

The aforementioned adhesion type cleaner and others have been successful in reducing the amount of contaminants. However, in order to manufacture a large-area optical film having uniform characteristics, conforming to a large-screen display, further reduction in the amount of contaminant is essential. When the adhesion type web cleaner is used to remove the fine contaminants or the contaminants firmly sticking onto the optical film, the adhesive force must be increased. Then when separating the optical film from the adhesion type web cleaner, it is necessary to use the separation force stronger by the level equivalent to the increased amount of adhesive force. This involves the risk of causing deformation of the optical film and reduction in the flatness of the optical film. In addition to this problem, it has also been made clear that, when the resin film substrate as a support member of the optical film is a thin film, the resin film substrate may break.

To remove the fine contaminants and the contaminants firmly sticking to the optical film using the brush type web cleaner, it is necessary to apply the brush firmly to the optical film and to rub it. This has often ended in damaging the surface of the optical film. When the brush is rubbed against the optical film to remove the sticky contaminants, the contaminants again stick to the surface of the optical film, with the result that satisfactory effect of removing the contaminants can not be obtained.

The object of the present invention is to solve the aforementioned problems and to provide an optical film manufacturing method capable of producing an optical film with the contaminants sufficiently removed from the surface thereof, using the method wherein the surface of the optical film is sprayed with the solidified blast material via cooling, which turns into a gas or liquid at the normal temperature and pressure. The other object of the present invention is to provide an optical film manufacturing method capable of producing an optical film with the contaminants sufficiently removed, wherein the flatness of the optical film is maintained without damaging the surface. This is intended to produce the optical film characterized by the high quality required of a large-screen display.

BRIEF DESCRIPTION OF THE DRAWINGS

Embodiments will now be described, by way of example only, with reference to the accompanying drawings which are meant to be exemplary, not limiting, and wherein like elements numbered alike in several figures, in which:

FIG. 3(*b*) is a diagram showing an example of an aspiration nozzle installed around a blast nozzle;

FIG. 4(*a*) is a table representing the result of evaluation in EXAMPLE 1 of the present invention (Examples 1-9);

FIG. 4(*b*) is a table representing the result of evaluation in EXAMPLE 1 of the present invention (Conditions A-I); and FIG. 5 is a table representing the result of evaluation in EXAMPLE 2 of the present invention.

DESCRIPTION OF THE PREFERRED EMBODIMENTS

Figure 1:
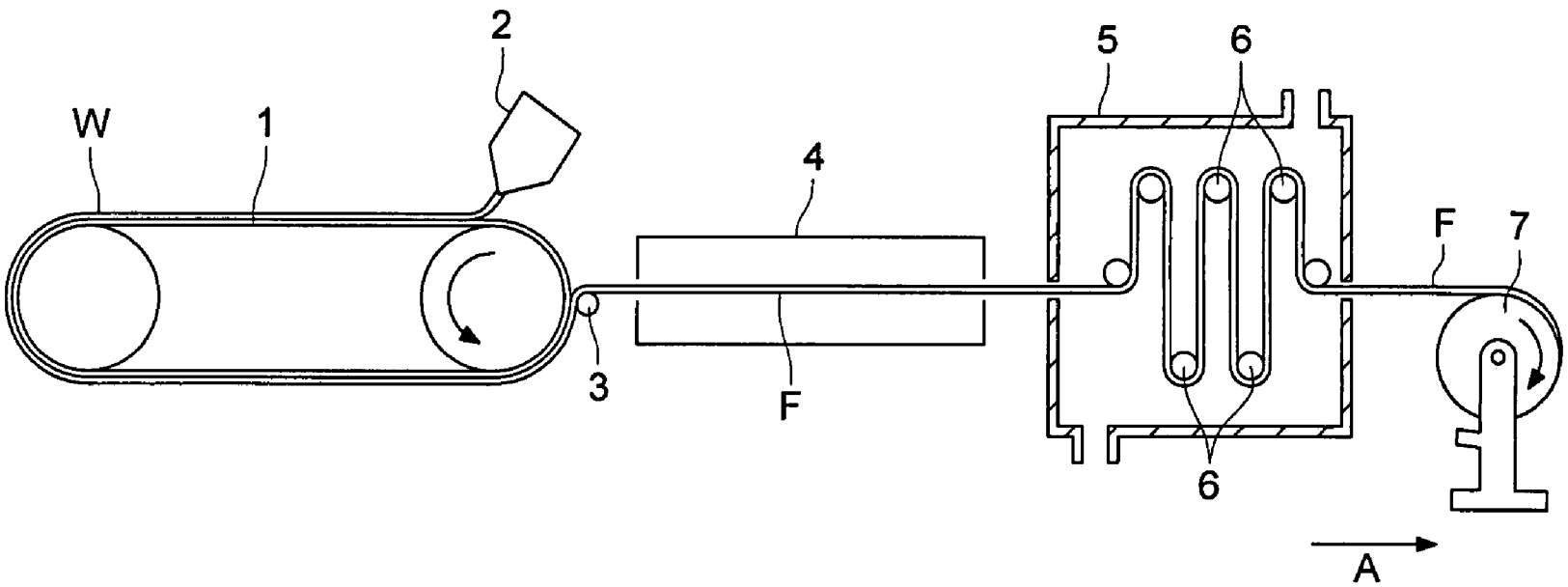
FIG. 1 is a diagram showing the production of an optical film and the removing (washing) process as the first embodiment of the present invention.

The above object of the present invention is accomplished by the following structures.

(Structure 1) A method of manufacturing an optical film, wherein the method possesses the steps of spraying onto at least one surface of a transparent film a solidified blast material via cooling that is a gas or a liquid at normal temperature and pressure, washing the at least one surface of the transparent film, and coating at least one optically functional layer on the washed surface of the transparent film.

The transparent film of the present invention includes the resin film substrate with a hard coated layer formed thereon, in addition to the resin film substrate manufactured by the solution-casting film formation method or melt-casting film formation method. The film of the present invention must be interpreted to include a sheet-like film. The dry ice formed by solidifying and cooling carbon dioxide is used as the blast material. The blast material made of dry ice is sprayed onto the surface of the transparent film at normal temperature and pressure, whereby contaminants are removed from the transparent film. If this dry ice blast material is sprayed onto the surface of the transparent film, contaminants are removed by the spray impact. Further, the surface of the transparent film is suddenly cooled by the dry ice blast material. Thus, removal of contaminants is facilitated by the abrupt temperature change. The air pressure produced at the time of sublimation of the dry ice blast material blows the contaminants off the surface of the transparent film. This phenomenon also serves to remove the contaminants. The blast material having been sprayed does not remain on the surface of the transparent film since it is sublimed at the normal temperature and pressure. In the present invention, the blast material is sprayed to the extent that it does not damage the transparent film. In addition, the above-described normal temperature and pressure mean 25° C. and atmospheric pressure.

When contaminants are removed from the transparent film by the adhesion type web cleaner of the conventional art, the adhesive strength must be increased. When the transparent film is separated from the adhesion type web cleaner, excess force is applied to the transparent film, with the result that the transparent film tends to deform. In the present invention, by contrast, contaminants are removed by spraying the blast material without using adhesion. This method allows the contaminants to be removed, wherein the transparent film is not deformed or the flatness is not adversely affected. For example, if the transparent film is supported by a support member from one face thereof the blast material is sprayed onto the other face, the contaminants can be removed without the flatness being adversely affected.

When contaminants are scraped off the transparent film by the brush type web cleaner of the conventional art, a substantial force must be applied to ensure sufficient removal of the contaminants by scraping. This often damages the surface of the transparent film. Further, highly sticky or adhesive foreign substances cannot be removed if any. In order to remove them, further force must be applied. This has increased the risk of further damaging the film. According to the present invention, however, even if highly sticky or adhesive foreign substances are found on the surface of the transparent film, force for separating the foreign substances is powerful enough to ensure satisfactory removal of the contaminants. Further, at the time of collision with the surface of the transparent film, the blast material is crushed. This reduces the risk of damaging the transparent film. An air layer is formed on the surface of the transparent film by the sublimation of the blast material, and the transparent film is protected by the presence of this air layer, with the result that the surfaced of the transparent film is not easily damaged.

The additive contained in the transparent film may ooze out onto the surface thereof. If the amount of the additive having oozed out is not uniform on the surface of the transparent film, the portions having poorer physical properties such as abrasion resistance will be created when another layer is formed on the transparent film by coating. These portions may appear as spots. According to the present invention, however, provides uniform removal of the contaminants partially sticking to the surface of the transparent film, with the result that the abrasive spots are reduced.

(Structure 2) The method of manufacturing an optical film of Structure 1, wherein the blast material is sprayed onto the transparent film from an opposite direction with respect to a predetermined direction, when the transparent film is moving in the predetermined direction.

(Structure 3) The method of manufacturing an optical film of Structure 1 or 2, wherein the blast material is sprayed in a plurality of separate batches onto the transparent film.

(Structure 4) The method of manufacturing an optical film of any one of Structures 1-3, wherein a surface temperature of the transparent film is set to 20-120° C. to spray the blast material onto the transparent film.

(Structure 5) The method of manufacturing an optical film of any one of Structures 1-3, wherein the surface temperature of the transparent film is arranged to a temperature of 20-120° C. via a hot-air blast to the transparent film before spraying the blast material.

(Structure 6) The method of manufacturing an optical film of any one of Structures 1-3, wherein the surface temperature of the transparent film is maintained at a temperature of 20-120° C. by holding the transparent film on a support member.

(Structure 7) The method of manufacturing an optical film of any one of Structures 1-6, wherein one surface of the transparent film is held by the support member, and the blast material is sprayed onto the opposite surface of the support member.

(Structure 8) The method of manufacturing an optical film of Structure 7, wherein the support member is composed of a roller member to wind the transparent film, or a belt member on which the transparent film is placed.

(Structure 9) The method of manufacturing an optical film of any one of Structures 1-8, wherein contaminants removed by spraying after spraying the blast material are aspirated from the periphery of the sprayed portion.

(Structure 10) The method of manufacturing an optical film of any one of Structures 1-9, wherein the transparent film is discharged by a discharging device.

(Structure 11) The method of manufacturing an optical film of Structure 10, wherein a charging amount of the transparent film immediately after spraying the blast material is arranged to not more than 1 kV by discharging the transparent film with the discharging device.

(Structure 12) The method of manufacturing an optical film of any one of Structures 1-11, wherein the blast material contains carbon dioxide.

(Structure 13) The method of manufacturing an optical film of any one of Structures 1-11, wherein the blast material is made of dry ice.

(Structure 14) The method of manufacturing an optical film of any one of Structures 1-13, wherein the blast material is sprayed onto the optical film under reduced pressure.

(Structure 15) The method of manufacturing an optical film of any one of Structures 1-14, wherein contaminants on the transparent film are removed employing at least one cleaner of an air type cleaner, an adhesion type cleaner and a brush type cleaner.

(Structure 16) The method of manufacturing an optical film of any one of Structures 1-15, wherein the transparent film is a film formed by coating a curable resin onto a resin film substrate prepared via film formation by solution-casting or melt-casting, to be cured and the method comprises the steps of spraying the blast material onto at least one surface of the resin film substrate, and washing the at least one surface of the resin film substrate, before coating the curable resin.

(Structure 17) The method of manufacturing an optical film of any one of Structures 1-15, wherein the transparent film is a film formed by coating the curable resin onto the resin film substrate prepared via film formation by solution-casting or melt-casting, to be cured, and subsequently wound by a winding roller, and the method comprises the steps of spraying the blast material onto at least one surface of the resin film substrate, and washing the at least one surface of the resin film substrate, before the winding process after curing the curable resin.

(Structure 18) An optical film, wherein a solidified blast material via cooling that is a gas or a liquid at normal temperature and pressure is sprayed onto at least one surface of a transparent film, and the at least one surface of the transparent film is washed.

While the preferred embodiments of the present invention have been described using specific terms, such description is for illustrative purposes only, and it is to be understood that changes and variations may be made without departing from the spirit or scope of the appended claims.

DETAILED DESCRIPTION OF THE INVENTION

Next, a washing method of an optical film relating to embodiments of the present invention will be described. A resin film is used as an optical film relating to these embodiments, and it is preferable that the resin film material exhibits easy-to-production, excellent adhesiveness to an actinic radiation curable resin, optical isotropy, and optical transparency. Herein, "transparency" means that a visible light transmittance is not less than 60%, preferably not less than 80%, and more preferably not less than 90%. Incidentally, an optical film is produced by coating at least one optically functional layer on the surface of a transparent film which has been washed via a washing process. Examples of an optically functional layer include a hard coat layer, an anti-glare hard coat layer, an antireflection layer, an anti-static layer, a view angle improving layer, an anti-stain layer, an optical compensating layer, a luminance enhancing layer, or a light diffusion layer, and these optically functional layers may be used in combination with two kinds or more.

Transparent substrate films are not particularly limited, provided that they exhibit the above properties. Examples include a cellulose ester based film, a polyester based film, a polycarbonate based film, a polyallylate based film, a polysulfone (including polyestersulfone) based film, a polyester film containing polyethylene terephthalate or polyethylene naphthalate, a polyethylene film, a polypropylene film, cellophane, a cellulose diacetate film, a cellulose triacetate film, a cellulose acetate propionate film, a cellulose acetate butyrate film, a polyvinylidene chloride film, a polyvinyl alcohol film, an ethylene vinyl alcohol film, a cyndioctatic polystyrene based film, a polycarbonate film, a cycloolefin polymer film (Arton, manufactured by JSR Co.), ZEONEX and ZEONOR (both manufactured by Zeon Corp.), a polymethylpentane film, a polyether ketone film, a polyether ketoneimide film, a polyamide film, a fluorine resin film, a nylon film, a polymethyl methacrylate film, an acryl film, or glass plates.

Of these, in view of transparency, a mechanical property, and optical non-anisotropy, preferred are a cellulose ester film such as a cellulose triacetate film (TAC film), cellulose acetate propionate film, and the like; a polycarbonate film (PC film), a cyndioctatic polystyrene based film, a polyallylate based film, a norbornene resin based film, and a polysulfone based film.

From the viewpoint of excellent workability accompanied with an easy film formation property, a cellulose ester film (TAC film) and a PC film are preferably employed, and it is particularly preferable that a TAC film is used. In view of production, cost, transparency, isotropy, and an adhesion property, preferably employed is a cellulose ester film (e.g., Konica Minolta Tac, a trade name, KC8UX2MW, KC4UX2MW, KC8UY, KC4UY, KC5UN, KC12UR, and KC8UCR-3, manufactured by Konica Minolta Opto, Inc.). These films may be prepared by a melt-casting film formation method or a solution-casting film formation method. Thickness of a substrate film is not particularly limited, but the substrate film has preferably a sheet thickness of 10-10,000 μm.

In the case of employing cellulose ester as a resin film substrate of the present invention, cellulose ester as a raw material for cellulose ester is not specifically limited, but usable are cotton linter, wood pulp (obtained from acicular trees or from broad leaf trees) or kenaf. The cellulose esters obtained from those may also be used by mixing with each other in any ratio. In case, an acid anhydride (acetic anhydride, propionic anhydride, and butyric anhydride) is used as an acylation agent, cellulose ester can be prepared through a common reaction using an organic acid such as acetic acid and an organic solvent such as methylene chloride, in the presence of a protic catalyst such as sulfuric acid.

The number average molecular weight of cellulose ester of the present invention is preferably 70,000-250,000 in order to obtain a sufficient mechanical strength of the film and to obtain moderate viscosity of the dope, and it is more preferably 80,000-150,000.

Herein, a method to produce a resin film substrate made of cellulose ester via a solution-casting film formation method is briefly described. Cellulose ester is produced via a method of casting a solution of dissolved cellulose ester (also referred to as a dope) from a pressure die onto a casting support, for example, an endless metal belt which is endlessly running, or a rotating metal drum to form a film.

The solution-casting film formation method will be further explained in detail referring to FIG. 1. As shown in FIG. 1, the dope which is a raw material solution used for a cellulose ester film, in general, is cast on support 1 of a rotating metal endless belt kept via die 2 to form web W (dope film). Web W is subsequently peeled from support 1 employing peeling roller 3 to obtain a peeled film designated as film F. Film F is stretched by tenter 4 (apparatus for stretching in the film width direction), and is dried with dryer 5 while film F is transported via a plurality of transport rollers 6. Cellulose ester film F obtained via a drying process is wound by winding roller 7.

The organic solvent preferably used for preparing a dope includes the one which dissolves cellulose ester and has a moderate boiling point, examples of which include: methylene chloride, methyl acetate, ethylacetate, amyl acetate, methyl acetoacetate, acetone, tetrahydrofuran, 1,3-dioxolane, 1,4-dioxane, cyclohexanone, ethyl formate, 2,2,2-trifluoro ethanol, 2,2,3,3-tetra-fluoro-1-propanol, 1,3-difluoro-2-propanol, 1,1,1,3,3,3-hexafluoro-2-methyl-2-propanol, 1,1,1,3,3,3-hexafluoro-2-propanol, 2,2,33,3-pentafluoro-1-propanol, nitroethane, 1,3-dimethyl-2-imidazolidinone. Of these, examples of a preferable organic solvent (namely, a good solvent) include an organic halogenated solvent such as methylene chloride or such; a dioxolane derivative, methyl-acetate, ethyl acetate, acetone, and methyl acetoacetate.

The boiling point of the organic solvent used in the present invention is preferably 30-80° C., in order to avoid foaming of the organic solvent in the web in the solvent evaporation process of the web, the web being a film of the dope formed by casting the dope on a casting support. Examples of boiling points of the above-described good solvents are as follows: methylene chloride (boiling point: 40.4° C.), methyl acetate (boiling point: 56.32° C.), acetone (boiling point: 56.3° C.) and ethylacetate (boiling point: 76.82° C.).

Among the above described good solvents, specifically preferable are methylene chloride or methyl acetate which is excellent in solubility of cellulose ester.

An alcohol having 1-4 carbon atoms of the content of 0.1-40% by weight is preferably contained in the above described organic solvent. The content is more preferably 5-30% by weight. When alcohol is contained in a web, after casting a dope on a support and the solvent being partially evaporated from the web, the relative concentration of alcohol becomes higher and the web begins to gelate. The gelation increases the mechanical strength of the web and makes it easier to peel the web from the support. A smaller concentration of alcohol in a dope may contribute to increase a solubility of cellulose ester in a non-chlorine based organic solvent.

Examples of an alcohol having a carbon number of 1 to 4 include: methanol, ethanol, n-propanol, iso-propanol, n-butanol, sec-butanol and tert-butanol.

Among these alcohols, ethanol is specifically preferable, because ethanol has a comparatively low boiling point, is stable in dope, is easy to be dried, and is non-toxic. It is preferable to use the solvent which contains 5-30% by weight of ethanol and 70-95 wt % of methylene chloride. Methyl acetate can also be used instead of methylene chloride. In this case, the dope solution may be prepared via a cooling solution process.

In addition, the residual solvent content of the web is expressed by the following formula:

$$\text{Residual solvent content (\% by weight)}=\{(M-N)/N\}\times 100$$

where M represents a weight of the web sample at any given point in time, and N represents a weight of the same sample after drying at 110° C. for 3 hours.

A method to produce a resin film substrate made of cellulose ester via a solution-casting film formation method is briefly described. The melt-casting film formation method is a method in which without using a solvent, cellulose ester is heat-melted to the temperature to result in fluidity, and casting is subsequently performed to extrude a fluid cellulose ester onto a metal belt or a drum to form a film.

In this embodiment, the cellulose ester film is a transparent support having a light transmittance of preferably at least 90 percent and more preferably at least 93 percent.

When a cellulose ester film is also employed as a hard coat layer support described later, it is preferred that a plasticizer, a UV absorbent or such is contained. After desired additives such as a plasticizer or a UV absorbent besides cellulose ester and a solvent are mixed with a solvent in advance to be dissolved or dispersed, they may be charged into a solvent before dissolving cellulose ester, or into a dope after dissolving cellulose ester.

The usable plasticizer of this embodiment is not specifically limited, but a phosphate ester plasticizer such as triphenyl phosphate (TPP), biphenyl diphenyl phosphate (BDP), tricresyl phosphate, cresyl diphenyl phosphate, octyl diphenyl phosphate, trioctyl phosphate or tributyl phosphate; a phthalate ester plasticizer such as diethyl phthalate, dimethoxy ethyl phthalate, dimethyl phthalate, dioctyl phthalate, dibutyl phthalate or di-2-ethylhexyl phthalate; a glycolate plasticizer such as triacetin, tributyrin, butyl phthalyl butyl glycolate, ethyl phthalyl ethyl glycolate (EPEG) or methyl phthalyl ethyl glycolate; a citrate ester plasticizer; or a polyvalent alcohol ester plasticizer is preferably used singly or in combination. The above plasticizers may be used in combination of at least two kinds. It is particularly preferable that films exhibiting excellent dimension stability as well as water resistance can be obtained by containing these plasticizers.

In view of film performance, workability and so forth, the usable amount of each of the above plasticizers is preferably 1-20% by weight, based on the cellulose ester content, and more preferably 3-15% by weight.

A UV absorbent is preferably used as a support for a resin film substrate. From the viewpoint of ensuring superb performance in absorbing the ultraviolet ray having a wavelength 370 nm or less and an excellent displaying property on the liquid crystal, the UV absorbent that does not absorb much of the visible light with a wavelength of 400 nm or more is preferably utilized to avoid degradation of liquid crystals. The usable UV absorbent is specifically exemplified by an oxybenzophenone compound, a benzotriazole compound, a salicylic acid ester compound, a benzophenone compound, a cyanoacrylate compound, a triazine compound or nickel complex salt compound, but the present invention is not limited thereto.

An actinic radiation curable resin layer is also coated on the above resin film substrate. This actinic radiation curable resin layer is employed as a hard coat layer. The hard coat layer is a layer to avoid scratches caused by a foreign matter contact on an image display device.

An actinic radiation curable resin layer refers to a layer mainly containing a resin which can be cured through a cross-linking reaction caused by irradiating with actinic radiation exposure such as UV rays or electron beams. Typical examples of actinic radiation curable resin include a UV radiation curable resin, an electron beam curable resin and so forth, but a UV radiation curable resin may be used. Examples of the UV radiation curable resin include a UV radiation curable acryl urethane resin, a UV radiation curable polyester acrylate resin, a UV radiation curable epoxy acrylate resin, a UV radiation curable polyol acrylate resin and a UV radiation curable epoxy resin.

The UV radiation curable urethane acrylate resin includes compounds which are generally prepared easily by, initially, reacting polyester polyol with a monomer or a prepolymer of isocyanate, followed by further reacting the product with an acrylate monomer having a hydroxy group such as 2-hydroxyethyl acrylate, 2-hydroxyethyl methacrylate (hereinafter, only acrylates are described, however methacrylates are also included) and 2-hydroxypropyl acrylate (refer to Japanese Patent O.P.I. Publication No. 59-151110, for example).

In general, the UV radiation curable polyester acrylate resins include compounds which are easily prepared by reacting a polyester polyol with a 2-hydroxyethyl acrylate monomer or a 2-hydroxy acrylate monomer (refer to Japanese Patent O.P.I. Publication No. 59-151112, for example).

The UV radiation curable epoxy acrylate resin includes compounds prepared by reacting an epoxy acrylate oligomer with a reactive dilutant and a photoreaction initiator (refer to Japanese Patent O.P.I. Publication No. 1-105738, for example). One kind or not less than two kinds of a benzoine derivative, an oxime ketone derivative, a benzophenone derivative, hydroxy benzophenone, a thioxanthone derivative, and so forth is/are selected to be used as the photoreaction initiator.

Examples of the UV radiation curable polyol acrylate based resin include trimethylol propane triacrylate, ditrimethylol propane tetracrylate, pentaerythritol triacrylate, pentaerythritol tetracrylate, dipentaerythritol hexaacrylate, alkyl modified dipentaerythritol pentaacrylate, and so forth.

The above-described resins are utilized together with a photo sensitizer. The above-described photoreaction initiator can also be utilized as a photosensitizer. Acetophenone, benzophenone, hydroxy benzophenone, Michler's ketone, α-amyloxim ester, thioxanthone and derivatives thereof are specifically provided. Further, sensitizers such as n-butyl amine, triethyl amine-and tri-n-butyl phosphine can be utilized together with an epoxy acrylate photoreaction agent.

Examples of resin monomers include methyl acrylate, ethyl acrylate, butyl acrylate, vinyl acetate, benzyl acrylate, cyclohexyl acrylate and styrene as a monomer having one unsaturated double bond; and ethyleneglycol diacrylate, propyleneglycol diacrylate, divinyl benzene, 1,4-cyclohexyane diacrylate and 1,4-cyclohexyldimethyl diacrylate, the foregoing trimethylolpropane triacrylate and pentaerythritol tetraacrylate ester as a monomer having two or more unsaturated double bonds.

Employed as specific examples of UV radiation curable resins may, for example, be ADEKA OPTOMER KR and BY Series such as KR-400, KR-410, KR-550, KR-566, KR-567, or BY-320B (all produced by Asahi Denka Kogyo Co., Ltd.); KOEIHARD such as A-101-KK, A-101-WS, C-302, C-401-N, C-501, M-101, M-102, T-102, D-102, NS-101, FT-102Q8, MAG-1-P20, AG-106, or M-101-C (all produced by Koei Chemical Industry Co., Ltd.); SEKABEAM such as PHC2210(S), PHC X-9 (K-3), PHC2213, DP-10, DP-20, DP-30, P1000, P1100, P1200, P1300, P1400, P1500, P1600, or SCR900 (all produced by Dainichi Seika Industry Co., Ltd.); KRM7033, KRM7039, KRM7130, KRM7131, UVECRYL29201, and UVECRYL29202 (all produced by Daicel UCB Co., Ltd.); RC-5015, RC-5016, RC-5020, RC-5031, RC-5100, RC-5102, RC-5120, RC-5122, RC-5152, RC-5171, RC-5180, and RC-5181 (all produced by Dainippon Ink & Chemicals Co., Ltd.); ORLEX No. 340 CLEAR (produced by Chugoku Paint Co., Ltd.); SUNRAD H-601 (produced by Sanyo Chemical Industry Co., Ltd.); SP-1509 and SP-1507 (both produced by Showa Polymer Co., Ltd.); RCC-15C (produced by Grace Japan Co., Ltd.); ARONIX M-6100, M-8030, and M-8060 (all produced by Toa Gosei Co., Ltd.), as well as any other commercially available products.

A solid content of an actinic radiation curable resin coating composition is preferably 10-95% by weight, and the content is appropriately selected, depending on a coating method.

Examples of a usable light source to cure layers of actinic radiation curable resin via photo-curing reaction include ultraviolet ray, electron beam, gamma ray and others. There is no restriction to the type of the light source if it can activate the actinic radiation curable resin as a glitter preventive composition. The ultraviolet ray and electron beam are preferably used. The ultraviolet ray is particularly preferred since handling is easy and a high level of energy can be easily obtained. Any light source capable of generating the ultraviolet ray can be used as the light source of the ultraviolet ray for causing photo-polymerization of ultraviolet ray reactive compound. For example, it is possible to use the low voltage mercury lamp, intermediate voltage mercury lamp, high voltage mercury lamp, extra-high voltage mercury lamp, carbon arc light, metal halide lamp and xenon lamp. Further, the ArF excimer laser, KrF excimer laser, excimer lamp and synchrotron radiation can also be used. The conditions on irradiation differs according to each type. The preferred amount of irradiation is 1 $mJ/cm^2$ or more. The more preferred amount is 20-10000 $mJ/cm^2$, and still more preferred amount is 50-2000 $mJ/cm^2$. A sensitizer having the absorption maximum in near-ultraviolet ray region through the visible ray region can also be employed.

An electron beam can also be used. It includes the electron beam having an energy of 50-1000 keV, preferably, 100-300 keV discharged from various types of the electron beam accelerators such as the Cockroft-Walton type, van de Graaff type, resonance transformer type, insulation core transformer type, linear type, dynamitron type, and high frequency type.

Examples of solvents to coat the foregoing resin layer when an actinic radiation curable resin is prepared for coating include hydrocarbons, alcohols, ketones, esters, glycol ethers and other organic solvents. These organic solvents may be selected to be used singly or in combination. A solvent containing at least 5% by weight of propylene glycol mono (C1-C4) alkyl ether or propylene glycol mono (C1-C2) alkyl ether ester is preferably used, and a solvent containing 5-80% by weight of that is more preferably used.

A commonly known method can be employed as a method of coating a UV radiation curable resin composition coating liquid onto a resin film substrate. The coated amount is suitably 0.1-30 μm in terms of wet layer thickness, but is preferably 0.5-15 μm. The coating rate is preferably in the range of 10-60 m/minute. It is possible to form each layer employing coating methods such as a dip coating method, an air-knife coating method, a curtain coating method, a roller coating method, a wire bar coating method, a gravure coating method, or an extrusion coating method (U.S. Pat. No. 2,681,294). At least two layers may be simultaneously coated. Simultaneous coating methods are described in U.S. Pat. Nos. 2,761,791, 2,941,898, 3,508,947, and 3,526,528, as well as Yuji Harazaki, Coating Kogaku (Coating Engineering), page 253, Asakura Shoten (1973).

A UV radiation curable resin composition is rapidly dried after coating, and UV radiation exposure from a light source is conducted. The duration of irradiation is preferably 0.1-60 seconds in order to obtain a sufficient amount of irradiation. The duration is preferably 0.5-300 seconds, and more preferably 3-120 seconds in view of hardening efficiency and working efficiency.

A thermosetting resin in place of an actinic radiation curable resin layer may be provided on a resin film substrate. Examples of the usable thermosetting resin include an unsaturated polyester resin, an epoxy resin, a vinyl ester resin, a phenol resin, a thermosetting polyimide resin, a thermosetting polyamide imide, and so forth.

The unsaturated polyester resin includes an orthophthalic acid resin, an isophthalic acid resin, a terephthalic acid resin, a bisphenol resin, a propylene glycol-maleic acid resin; a low-styrene volatile resin obtained by introducing dicyclopentadiene or the derivative thereof into an unsaturated polyester composition to reduce the molecular weight or by adding a wax compound capable of forming a film; low-shrinkage resin obtained by adding a thermoplastic resin (polyacetic acid vinyl resin, styrene/butadiene copolymer, polystyrene, saturated polyester, etc.); reactive type obtained by directly brominating the unsaturated polyester using the $Br_2$ or by copolymerizing the HET acid and dibromneopentyl glycol; a flame resistant resin of additive type wherein a combination of such a halide as chlorinated paraffin and tetrabrom bisphenol, antimony trioxide and phosphorus compound, and aluminum hydroxide are used as additives; and durable resin characterized by high durability (characterized by high strength, modulus of elasticity and elongation) produced by hybridization with polyurethane and silicone or by introduction of IPN.

The epoxy resin is exemplified by a glycidyl ether based epoxy resin such as bisphenol A type, novolak phenol type, bisphenol F type, brominated bisphenol A type; and a special epoxy resin including a glycidyl amine epoxy resin, a glycidyl ester epoxy resin, a cyclic aliphatic resin and a heterocyclic epoxy resin.

The vinyl ester resin is produced by dissolving the oligomer into the monomer of styrene and others, wherein the oligomer is obtained by reaction of ring opening and addition of the unsaturated monatomic acid of the conventional epoxy resin and methacrylic acid. There is also a special type resin having a vinyl group on the terminal and side chain of the molecule and containing a vinyl monomer. The vinyl ester resin of the glycidyl ether epoxy resin includes the bisphenol based, novolak based and brominated bisphenol based epoxy resin. The special vinyl ester resin includes a vinyl ester urethane based, isocyanuric acid vinyl based and side chain vinyl ester resin.

The phenol resin is produced by polycondensation of the phenols and formaldehydes as materials. It is available in two types; a resol type and a novolak type.

The polyimide resin is exemplified by maleic acid based polyimide such as polymale imide amine, polyamino bismale imide, a bismale imide-O,O'-dialylbisphenol-A resin and a bismale imide-triazine resin, and so forth. The nadic acid-modified polyimide and acetylene terminal polyimide are also included in this category.

Some of the aforementioned actinic radiation curable resins can also be used as thermosetting resins.

Although there is no particular restriction to the method of heating, use of a heat plate, heat roll, thermal head or hot air spraying is preferred. The heating temperature cannot be generally specified, since it varies according to the type of the thermosetting resin to be used. It is preferred to be within the range wherein such influence as thermal deformation will not be given to the transparent substance. To put it more specifically, the heating temperature is preferably from 30 through 200° C., more preferably from 50 through 120° C., particularly preferably from 70 through 100° C.

The following describes the washing process contained in the optical film manufacturing method as an embodiment of the present invention. This washing process is applied to the aforementioned resin film substrate, as well as to the optical film after a hard coated layer has been formed.

First Embodiment

In the first place, the following describes the optical film washing method as the first embodiment of the present invention. In the washing process contained in the optical film manufacturing method as the first embodiment, the blast material of dry ice is sprayed onto the resin film substrate to remove the contaminants from the surface of the resin film substrate.

In the washing process of this embodiment, the blast material is sprayed onto at least one of the faces o the resin film substrate produced by the aforementioned solution-casting film formation method or melt-casting film formation method, whereby contaminants are removed from the surface of the resin film substrate. The blast material is manufactured by cooling and solidifying the substance that will become a gas or liquid, at the normal temperature and pressure. For example, dry ice is manufactured by cooling and solidifying the carbon dioxide and is crushed by a crusher. Alternatively, it is once formed into pellets by a pelletizer, and is then crushed. Alternatively, dry ice particles are produced and are used as blast materials. The blast material is sprayed from a gun or blast nozzle onto the surface of the resin film substrate by compressed air. The blast material made of dry ice can be manufactured by a known dry ice blast apparatus. The compressed air is preferably kept at a dew point of approximately −50° C. This is intended to avoid dew condensation on the surface of the resin film substrate since the dry ice has a temperature of approximately −78° C.

For example, a resin film substrate is manufactured so that the film thickness will be 30 μm through 150 μm. When the dry ice particle is used as a blast material, the average particle diameter is 1 μm through 15 mm. When the pellet-like blast material is used, the diameter is approximately 3 mm, and the length is 1 mm through 10 mm. Further, the dry ice blast material is sprayed onto the surface of the resin film substrate at such a speed (pressure) that the surface of the resin film substrate is not damaged. The blast material is sprayed onto the surface of the resin film substrate, for example, at a speed of less that 100 m/sec. The pressure of the air is for example 3.5 $kg/cm^2$ when sprayed on the resin film substrate. The spray speed and pressure are adjusted as appropriate according to the material of the resin film substrate. In the case of the hard resin film substrate, the surface is not easily damaged, regardless of whether the spraying speed is high or low. As the surface of the resin film substrate is softer, the surface is more easily damaged. This requires the spraying speed to be reduced (the pressure to be reduced).

The blast material is sprayed at the temperature and pressure wherein the blast material is sublimated after the dry ice blast material has been sprayed to the resin film. For example, when the resin film substrate is sprayed to the resin film substrate at the normal temperature and pressure blast material, the blast material having been sprayed is sublimated to become a gas. Accordingly, no blast material remains on the surface of the resin film substrate.

The film thickness of the resin film substrate, and the dimensions and shape of the blast material are not restricted to the aforementioned values and shape. In response to the size of the contaminants and the strength of adhesion, the size of the dry ice blast material, and the spraying speed and pressure are adjusted so that the surface of the resin film substrate will not be damaged. This arrangement provides sufficient removal of the contaminants.

The dry ice blast material is emitted from a gun or blast nozzle, and the size of the dry ice blast material may be controlled in the air while the material is being sprayed to the resin film substrate. The size of the solidified blast material is reduced at the normal temperature and pressure since the dry ice blast material is sublimated. Accordingly, the size of the blast material reaching the resin film substrate is greater as the distance from the gun or blast nozzle to the resin film substrate is longer. As described above, when the distance from the gun or blast nozzle to the resin film substrate is changed, the size of the blast material reaching the optical film can be changed. This makes it possible to control the size of the blast material by changing the distance, and to carry out removal (washing) in response to the size of the contaminants and strength of adhesion.

For example, when the resin film substrate is produced by the solution-casting film formation method, the dry ice blast material is sprayed at the following timing: A dry ice blast apparatus is provided between dryer 6 and winding roller 7 shown in FIG. 1. The solvent is evaporated by dryer 6. Before the film is wound up by winding roller 7, the dry ice blast material is sprayed to the resin film substrate to remove the contaminants.

When the aforementioned dry ice blast material is sprayed to the surface of the resin film substrate, the contaminants are removed from the surface by the impact of the spray. The surface of the resin film substrate is abruptly cooled by the dry ice blast material. Removal of contaminants is facilitated by the abrupt temperature change. As described above, when the dry ice blast material is sprayed, a sufficient amount of contaminants can be removed by the impact thereof and abrupt temperature change.

To remove the resin film substrate by the adhesion type web cleaner of the conventional art, adhesion must be increased. Accordingly, when separating the resin film substrate from the adhesion type web cleaner, excess force is applied to the resin film substrate, facilitating deformation of the resin film substrate. By contrast, when the washing method of this embodiment is used, the contaminants are removed by spraying of the dry ice blast material. This method eliminates the use of adhesion to remove the contaminants, and therefore, the contaminants can be removed without deforming the resin film substrate. This arrangement allows the contaminants to be removed without adversely affecting the flatness of the resin film substrate.

When the contaminants from the resin film substrate is scraped off by the brush type web cleaner according to the conventional art, force must be used to ensure sufficient removal of contaminants. This may damage the surface of the resin film substrate. This method fails to achieve sufficient removal of the sticky and adhesive foreign substances. In order to scrape off the foreign substances, further force must be used, and this will increase the risk of damaging the film. By contrast, when the washing method of this embodiment is employed, sufficient removal of the sticky and adhesive foreign substances is provided by spraying of the dry ice blast material. When the blast material has collided with the resin film substrate, the blast material is crushed, and this reduces the risk of damaging the surface of the resin film substrate. As described above, the washing method of this embodiment removes the contaminants without damaging the resin film substrate, when compared to the conventional art.

Further, the additive contained in the film may ooze out on the surface of the resin film substrate. If the amount of the ooze is not uniform on the surface of the resin film substrate, some portions with poor abrasion resistance will be created when a hard coated layer or antireflection layer has been formed on the resin film substrate by coating. These portions may appear as spots. However, the washing method of this embodiment ensures uniform removal of contaminants attached partially on the surface of the resin film substrate, whereby the amount of the abrasive spots is reduced.

As described above, the washing method of this embodiment ensures sufficient removal of the contaminants from the resin film substrate by reducing the amount of abrasive spots without adversely affecting the flatness or without damaging the surface, thereby providing an optical film of high quality required of a large-screen display.

Second Embodiment

Figure 2:
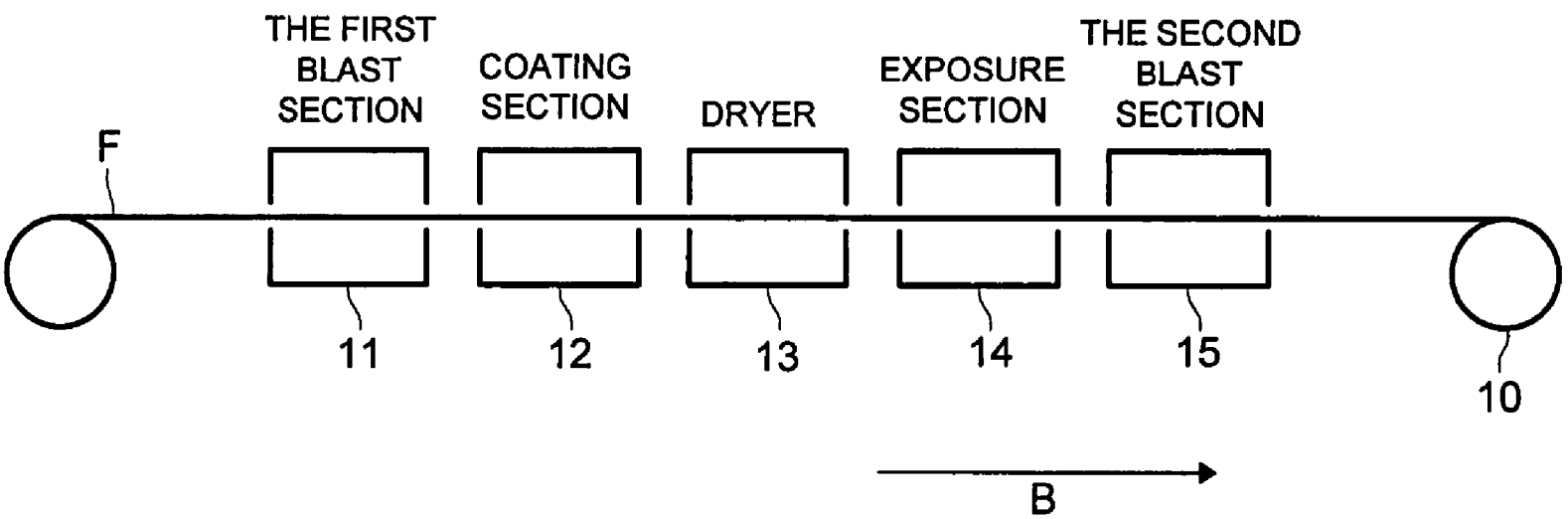
FIG. 2 is a diagram showing the production of an optical film and the removing (washing) process as the second embodiment of the present invention.

Referring to FIG. 2, the following describes the washing method of an optical film of the second embodiment. FIG. 2 is a diagram representing the manufacture of the optical film and the removing (washing) process as the second embodiment of the present invention. In the second embodiment, a hard coated layer is formed on the resin film substrate formed by the solution-casting film formation method or melt-casting film formation method, and dry ice blast material is sprayed to the hard coated layer to remove the contaminants from the surface of the hard coated layer.

For example, when the ultraviolet curable ink is used to form a hard coated layer, the dry ice blast material is sprayed to resin film substrate F by first blast section 11 to remove the contaminants from the surface, as shown in FIG. 2. This resin film substrate F is the film produced by the aforementioned solution-casting film formation method and melt-casting film formation method. As described above, before the UV radiation curable resin layer is coated by coating section 12, the contaminants are removed from the surface of the resin film substrate F. After spraying by the first blast section 11, the UV radiation curable resin composition coating solution is coated on resin film substrate F by coating section 12. After that, the film substrate is dried by dryer 13 so that the solvent evaporates. Ultraviolet rays are applied to the hard coated layer by exposure section 14, whereby the hard coated layer is cured and the optical film is wound on roller 10. The dry ice blast material is sprayed under the same conditions as those for spraying in the first embodiment.

As described above, before coating of the UV radiation curable resin, contaminants are removed from the resin film substrate by the dry ice blast material. This arrangement ensures effective formation of a hard coated layer.

After curing of the hard coated layer, the dry ice blast material is sprayed to the hard coated layer by second blast section 15, and contaminants are removed from the surface. After that, the optical film can be wound on roller 10. The dry ice blast material is sprayed under the same conditions as those for spraying in the first embodiment. When the thermosetting resin is used as the hard coated layer, curing is performed by heat treatment and a hard coated layer is formed on the resin film substrate F. After that, the dry ice blast material is sprayed by the second blast section 15 to remove the contaminants.

As described above, after formation of the hard coated layer, almost the same effect as that in the first embodiment can be obtained when the dry ice blast material is sprayed by second blast section 15. Further, the greater effect can be obtained when combined with the spraying by first blast section 11. To be more specific, the dry ice blast material is sprayed to the hard coated surface. Then the contaminants are removed from the surface by the impact of spraying. Further, the hard coated surface is abruptly cooled by the dry ice blast material. Accordingly, the contaminants can be easily removed by the abrupt temperature change. Thus, when the dry ice blast material is sprayed, sufficient removal of the contaminants from the surface is provided by the impact thereof and the abrupt temperature change.

Further, the dry ice is sublimed at the normal temperature and pressure. This prevents the blast material from remaining on the hard coated layer surface. Moreover, since the dry ice blast material is used, contaminants can be removed without deforming the optical film with the hard coated layer formed thereon. This arrangement ensures that the flatness of the optical film is kept unaffected. Moreover, unlike the brush type web cleaner of the conventional art, the washing method of this embodiment does not required the contaminants to be scraped off. This allows the contaminants to be removed without damaging the hard coated layer. Further, the washing method of this embodiment removes the contaminants partially sticking to the resin film substrate surface to get a uniform surface. This arrangement reduces the amount of abrasive spot as compared with the washing method according to the conventional art.

As described above, without adversely affecting the flatness or damaging the surface, the washing method of this embodiment allows the abrasive spot to be reduced, and ensures sufficient removal of the contaminants from the resin film substrate. Thus, the washing method of this embodiment provides an optical film of high quality required of a large-screen display.

In the aforementioned first and second embodiment, it is also possible to make such arrangements that the optical film is supported by a support member from one face of the optical film, and the blast material is sprayed to the face opposite to the supported face. For example, the optical film is kept in contact with the roller member. Under this condition, the blast material is sprayed to the face opposite to the face in contact. The optical film is placed on the belt member and the blast material is sprayed to the face opposite to the belt member. Since the optical film is supported by the support member, the force of the blast material is effectively conveyed to the optical film surface. This provides effective removal of the contaminants from the optical film surface. Further, since the optical film is supported by the support member, the optical film is kept flat.

When the blast material of dry ice is sprayed from the direction opposite to the traveling direction of the optical film, the force of the blast material is effectively conveyed to the optical film surface. Accordingly, contaminants can be removed more easily. For example, in FIG. 1, when the resin film substrate is being fed in the direction A, the blast material of dry ice is sprayed to the resin film substrate from the direction opposite to the traveling direction (marked by arrow A) of the optical film. In FIG. 2, when the resin film substrate with a hard coated layer formed thereon is being fed in the direction marked by arrow B, the blast material of dry ice is sprayed to the hard coated layer surface from the direction opposite to the traveling direction (marked by arrow B) of the optical film. In the manner described above, if the blast material of dry ice is sprayed from the direction oblique to the optical film, easier separation and removal of contaminants from the optical film surface will be ensured. Especially, effective removal of contaminants will be ensured if the blast material of dry ice is sprayed from the direction opposite to the traveling direction of the optical film.

Further, to avoid dew condensation of the surface of the optical film, the temperature of the optical film is set to a level equal to or greater than the room temperature. For example, the atmospheric dew point is reduced to the level not exceeding 10° C., preferably less than 0° C. The temperature of the optical film surface is kept within the range of 20-120° C. It should be noted, however, that the resin film produced by the melt-casting film formation method must be kept at such a temperature that it will not melt. Thus, if the temperature of the optical film surface is kept within the range of 20-120° C., reduction of the optical film temperature can be avoided at the time of spraying of the blast material of dry ice, and dew condensation can be prevented.

To put it more specifically, before the blast material of dry ice is sprayed to the optical film, hot-air is blown to the optical film by a dryer or the like, so that the temperature of the optical film surface will be kept within the range of 20-120° C.

It is also possible to take the following method: Before the blast material of dry ice is sprayed to the optical film, such a support member as a roller member or belt member for conveying the optical film is heated so that the optical film in contact with the support member will be heated. For example, the optical film is heated by the support member having a temperature higher than that of the optical film surface. The temperature of the support member is adjusted so that the optical film surface will have the temperature ranging from 20° C. through 120° C. This arrangement avoids excessive cooling of the optical film. Further, in the process of spraying the blast material of dry ice and the subsequent process, this arrangement avoids dew condensation on the optical film. The support member can be heated by allowing hot water or the like to flow through the roller member. Alternatively, an electric jacket roll can be used as the roller member.

Dew condensation may occur when cooled by the dry ice. To prevent this, the atmospheric dew point is preferably reduced before, during and after spraying of the blast material. For example, the dew point is preferably reduced to or below 10° C., or more preferably reduced to 0° C. or less. To put it more specifically, the process of spraying is carried out in the chamber, which is filled with the sublimed carbon dioxide gas and nitrogen gas, thereby reducing the dew point. Alternatively, it is also possible to make such arrangements that the chamber is filled with the dry air having a dew point of −60° C., for example. Under this environment, the blast material of dry ice is sprayed to the optical film.

Further, the blast nozzle for spraying the blast material is provided with an aspiration nozzle. The contaminants having been removed are sucked into the aspiration nozzle. The contaminants can be removed from the optical film surface. When the contaminants are removed from the optical film by the blast material, the contaminants will float around the optical film. If this is left without any step taken, the contaminants may adhere again to the optical film, and the optical film may be contaminated. The contaminants having been removed by the blast material are sucked and ejected immediately. This arrangement will achieve complete removal of the contaminants located around the optical film, and ensures that the contaminants having been removed by the blast material do not adhere against to the optical film.

Figure 3:
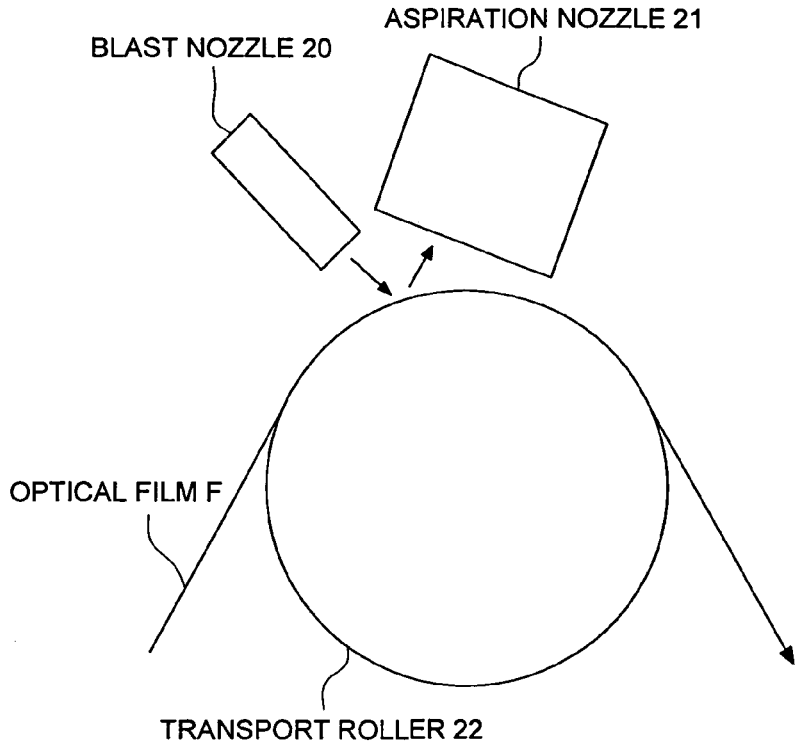
FIG. 3(*a*) is a diagram showing an example of an aspiration nozzle installed on the side opposite to spraying.
Figure 3:
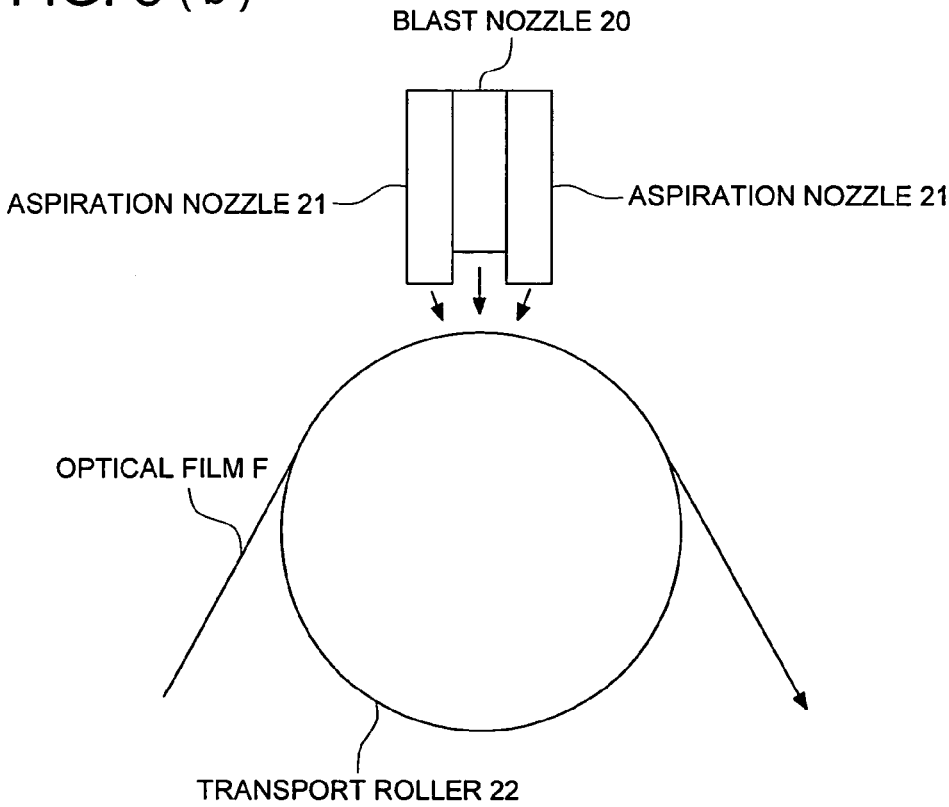

For example, as shown in FIG. 3(*a*), blast nozzle 20 is place obliquely to the optical film F on transport roller 22, and the blast material is sprayed to optical film F in the oblique direction. Aspiration nozzle 21 is installed on the side opposite to spraying. The contaminants separated from optical film F by the spraying of the blast material are sucked by aspiration nozzle 21, and are ejected immediately.

As shown in FIG. 3(*b*), it is also possible to arrange such a configuration that aspiration nozzle 21 is installed around blast nozzle 20. In this arrangement, aspiration nozzle 21 is installed so as to surround the portion of optical film F to which the blast material is sprayed, whereby the contaminants having been separated are sucked and ejected immediately. At the time of sublimation of the blast material, the air pressure is produced in all the directions from the portions where the blast material is sprayed. Accordingly, when the portion exposed to spraying is surrounded by aspiration nozzle 21, the contaminants scattering around can be sucked and ejected immediately.

To ensure that the contaminants having been removed by spraying of the blast material of dry ice will not stick again to the optical film surface, it is possible to use a discharging device to discharge the surface of the optical film, and to spray the dry ice blast material to the surface. Further, discharging can also be made before the blast material of dry ice is sprayed. For example, discharge conditions are determined to ensure that the amount of change of the optical film after the blast material of dry ice has been sprayed will not exceed 1 kV. After that, discharging is performed. If the discharging is performed until the amount of charge does not exceed 1 kV, the contaminants having been removed do not stick again to the optical film. Moreover, the dust present in the atmosphere does not stick to the optical film. To put it more specifically, an ion generating electrode is installed in the blast nozzle for spraying the blast material of dry ice, so that the blast material is sprayed to the optical film, and the surface of the optical film is discharged.

It is also possible to spray the blast material of dry ice and to remove the contaminants from the surface of the optical film. After that, the optical film is further washed using the known means of washing. The air type web cleaner, adhesion type web cleaner or brush type web cleaner can be mentioned as the known means for washing.

The following arrangement can also be used: When the blast material of dry ice is sprayed to the optical film surface, optical film is stored in an enclosed chamber. The pressure inside the chamber is reduced below the external pressure. Under this condition, the blast material of dry ice is sprayed. For example, the pressure is reduced in such a way that the inner pressure will be about 10 Pa lower than the external pressure. If the blast material of dry ice is sprayed under this pressure, the contaminants having been removed by spraying do not stick again to the optical film surface. In response to the pressure reduction by about 10 Pa, the dry ice blast material is sublimed to turn into a gas. This ensures that the effect of the dry ice blast method is not adversely affected.

Further, the optical film is preferably washed after the contaminants have been removed by the blast material of dry ice. For example, the optical film having been cleaned by the blast material of dry ice is immersed in a water tank filled with water to remove the contaminants still remaining on the optical film surface. More effective removal of the contaminants will be provided by washing the optical film using a washing agent. The remaining contaminants can be removed by high-speed spraying of the washing solution to the optical film. Further, effective removal of the remaining contaminants is also ensured by applying the ultrasonic wave to the optical film using the ultrasonic wave washer or ultrasonic wave transmitter. Instead of washing, the method of saponification can also be used. It is also possible to spray a washing agent to the optical film being fed on the belt member or wound on the roller member, thereby removing the remaining contaminants. Water or water supplied with additional activator is used as the washing agent. After the contaminants have been removed by the washing agent, the optical film is washed by water and is then dried. In this case, the washing solution is used after it has been passed through a filter to remove foreign substances. After washing, the washing solution on the optical film is dried.

The blast material of dry ice can be sprayed to the optical film in a plurality of separate batches. For example, a plurality of dry ice blast apparatuses are installed. The blast materials of dry ice having the same or different particle sizes are sprayed to the optical film from each of dry ice blast apparatuses. The dry ice blast apparatus is capable of producing a limited amount of the blast material of dry ice. Accordingly, if there is a large quantity of the blast material of dry ice to be used, a plurality of dry ice blast apparatuses are preferably installed for processing. To be more specific, if only one dry ice blast apparatus is installed for processing, the blast material of dry ice will be in short supply and satisfactory removal of the contaminants may not be achieved. Such being the case, a plurality of dry ice blast apparatuses are preferably installed and the blast materials of dry ice are sprayed in a plurality of separate batches. This will ensure sufficient removal of the contaminants.

EXAMPLE

The following describes the washing method of an optical film in the present invention with reference to specific EXAMPLE.

Example 1

The following describes EXAMPLE 1 with reference to the Table given in FIG. 4: In EXAMPLE 1, the blast material of dry ice was sprayed under the following conditions to the surface of the resin film substrate produced by the aforementioned solution-casting film formation method or melt-casting film formation method. The contaminants were removed from the surface of the resin film substrate. After spraying, the resin film substrate was coated with a hard coated layer, and was dried by a dryer. Then a hard coat layer was cured by curing. After formation of the hard coat layer, an evaluation was made of the flatness, point defect (contaminant trouble) and damages.

<Dry Ice Blast Conditions>

Shape and size of the dry ice: Pellet-like blast material having an average particle diameter of $\phi 3 \times 2$ mm Supplied air pressure: 3.5 kg/cm$^2$ Under this condition, the blast material of dry ice was sprayed to the resin film substrate surface to remove the contaminants. After that, the following hard coat layer was formed. Subsequent to formation of the hard coat layer, an evaluation was made of the flatness, point defect (contaminant trouble) and damages.

[Producing the Hard Coat Layer]

Under the aforementioned dry ice blast condition, the blast material of dry ice was sprayed to the surface of a long resin film substrate having a width of 1.3 m, a thickness of 80 μm and a length of 2000 m to remove the contaminants from the surface of the resin film substrate. After that, the coating solution for the following hard coat layer (UV radiation curable resin layer) was filtered by the polypropylene-made filter having a pore diameter of 0.4 μm. The coating solution for the hard coat layer was adjusted and was coated using a microgravure coater. After drying at 90° C., the coating layer was cured by the exposure section having at a dose of 0.1 J/cm$^2$ with an intensity of illumination of 100 mW/cm$^2$ using an ultraviolet lamp. Then a hard coat layer having a thickness of 10 μm was formed.

<Coating Solution for Hard Coat Layer>

Dipentaerythritol hexaacrylate: 100 parts by weight

Photoreaction initiator [Irgacure 184 (Ciba Specialty Chemicals K.K.)]: 5 parts by weight Ethylacetate: 120 parts by weight Propylene glycol monomethylether: 120 parts by weight Silicon based surface activator (BYK-307 (BYK-Chemie Japan K.K.)): 0.4 parts by weight Comparative Example The following lists up Comparative examples (prior arts) by contrast the aforementioned Example 1:

Comparative example 1: Contaminants were removed from the surface of the resin film substrate by an adhesion type web cleaner, and a hard coat layer was formed.

Comparative example 2: Contaminants were removed from the surface of the resin film substrate by a brush type web cleaner, and a hard coat layer was formed.

Comparative example 3: A hard coat layer was formed without the contaminants being removed from the resin film substrate surface.

In FIG. 4, Examples 1-9 show the results of removing the contaminants in this EXAMPLE. In Examples 1-9, the blast material of dry ice is sprayed to the surface of the resin film made of the cellulose triacetate film (TAC film) produced by the aforementioned solution-casting film formation method or melt-casting film formation method, whereby the contaminants were removed from the surface of the resin film substrate. TAC film KC8UX by Konica Minolta Opt, Inc. was used as the resin film substrate. In Comparative examples 1-3 (prior arts), the resin film substrate made of the cellulose triacetate film (TAC film) was also used.

The details of the conditions A through I in FIG. 4(*a*) are shown in FIG. 4(*b*). For example, Example 1 shows the result of removing under condition A. As shown in FIG. 4(*b*), when the atmospheric temperature was 20° C. with the resin film substrate (support member) set at a temperature of 20° C. and the atmospheric dew point set at less than 0° C., the blast material of dry ice was sprayed to the resin film substrate. Then a hard coat layer was formed. These steps and the result of evaluation are given in this Example. For example, Example 5 shows the result of removing the contaminants under condition E. As shown in FIG. 4(*b*), when supported by the roller member (support member) having a diameter of 500 mm at 30° C., discharging was performed by a discharging device, wherein the atmospheric temperature was 30° C. with the resin film substrate (support member) set at a temperature of 30° C. and the atmospheric dew point set at less than 0° C. An aspiration nozzle was provided to perform suction. The blast material of dry ice was sprayed to the surface of the resin film substrate. After that, a hard coat layer was formed. These steps and the result of evaluation are given in Example 5. In other Examples, removal of contaminants (washing) was conducted under the conditions given in FIGS. 4(*a*) and (*b*).

<Evaluation of Flatnes>

The flatness was evaluated by the laser displacement meter (LT-8100 by Keyence Corp.; resolution: 0.2 μm). The laser displacement meter was applied across the width of the optical film forming the aforementioned hard coat layer to measure the fine protrusion of the hard coat layer surface, whereby the flatness of the optical film was evaluated. To evaluate the flatness, an optical film was placed on a flat and level table and both sides across the optical film were secured to the table using a tape. A measuring camera was installed on the traveling rail (by Sigma Koki K.K.) in such a way that the distance between the camera lens and optical film will be 25 mm. The film was moved at a traveling speed of 5 cm/min to measure the protrusion. To observe the waviness of the film per se, measurement was performed opposite to the side provided with the hard coat layer.

A: The size of the roughened structure caused by the deformation of the optical film is less than 0.5 μm.

B: The size of the roughened structure caused by the deformation of the optical film is 0.5 μm or more to 1.0 μm exclusive.

C: The size of the roughened structure caused by the deformation of the optical film is 1.0 μm or more to 3.0 μm exclusive.

D: The size of the roughened structure caused by the deformation of the optical film is 3.0 μm or more.

In Examples 1-9 (EXAMPLE), the result of evaluation was "B" or "A", as shown in the Table of FIG. 4(*a*). On the other hand, the result of evaluation was "D" in Comparative example 1, "C" in Comparative example 2, and "A" in Comparative example 3. These results indicate that the flatness is damaged if the contaminants are removed by the adhesion type web cleaner or brush type web cleaner, as in Comparative examples 1 and 2. By contrast, it has been shown in EXAMPLE of the present invention that, when the blast material of dry ice is sprayed to remove the contaminants, a satisfactory optical film can be produced without the flatness being adversely affected.

<Inspection of Point Defect and Contaminant Trouble>

A sample (optical film) 100 cm in width and 100 cm in length was taken from the optical film with the aforementioned hard coat layer formed thereon. The sample was then placed on a table. Five 50 W fluorescent lamps were arranged. The fluorescent lamps were secured at a height of 1.5 m from the table so that light was applied at an angle of 45° with respect to the table. The hard coat layer of the sample (optical film) was exposed to the light of these fluorescent lamps to count the point defects (contaminant troubles), having a size of 100 μm or more, that could be observed visually.

In the Examples 5-9 (EXAMPLE), the results of evaluation were 0-1 $cm^2$, as shown in the Table of FIG. 4(*a*). In the Examples 1-4 (EXAMPLE), it was found out that there was a reduction in the number of contaminants, as compared with Comparative examples 1-3. These results revealed that, in Comparative examples 1 and 2, contaminants could not be removed sufficiently, but in EXAMPLE of the present invention, sufficient removal of the contaminants could be achieved.

<Damage Inspection>

A sample (optical film) 100 cm in width and 10 cm in length was taken from the optical film with the aforementioned hard coat layer formed thereon. The sample was then placed on a table. Five 50 W fluorescent lamps were arranged. The fluorescent lamps were secured at a height of 1.5 m from the table so that light was applied at an angle of 45° with respect to the table. The hard coat layer of the sample (optical film) was exposed to the light of these fluorescent lamps to count the damages (damages of the resin film substrate), having a size of 100 μm or more, that could be observed visually.

A: The number of damages is 0-1/$m^2$.

B: The number of damages is 2-4/$m^2$.

C: The number of damages is 5-10/$m^2$.

D: The number of damages is 10/$m^2$ or more.

In Examples 1-9 (EXAMPLE), the results of evaluation were "A", as shown in the Table of FIG. 4(*a*). The result of evaluation was "B" in Comparative example 1, and "D" in Comparative example 2. These results indicate that the optical film surface may be damaged in Comparative examples 1 and 2, and a satisfactory optical film may not be produced. In EXAMPLE of the present invention, however, sufficient removal of the contaminants can be achieved without the optical film surface being damaged.

The evaluation of the aforementioned flatness, and inspection of the point defects (contaminant troubles) and damages can be summarized as follows: In Comparative examples 1-3, flatness was adversely affected and the surface was damaged. Sufficient removal of contaminants cannot be achieved. In EXAMPLE of the present invention, sufficient removal of contaminants from the surface was achieved, without the flatness of the optical film being adversely affected or the surface being damaged. As described above, the washing method in EXAMPLE of the present invention produces a satisfactory optical film, and hence provides an optical film of the high quality required of a large-screen display.

Example 2

Referring to FIG. 5, the following describes EXAMPLE 2: Subsequent to formation of a hard coat layer in EXAMPLE 1, the blast material of dry ice was sprayed to the surface of the hard coat layer in EXAMPLE 2 to remove the contaminants from the surface of the hard coat layer surface. After that, the following antireflection layer was formed on the hard coat layer. Subsequent to formation of an antireflection layer, the flatness, point defects (contaminant troubles) and abrasive spots were evaluated. Dry ice blast conditions are the same as those in EXAMPLE 1.

[Preparation of Antireflection Layer]

The cured hard coat layer was coated with the coating solution for the following intermediate refractive index layer. After having been dried at 70° C., the coating layer was exposed to ultraviolet rays and was cured so as to form an intermediate refractive index layer (refractive index: 1.72; film thickness: 85 nm). This was coated with the coating solution for the following high refractive index layer by the bar coater. After having been dried at 70° C., the coating layer was exposed to ultraviolet rays and was cured so as to form a high refractive index layer (refractive index: 1.9; film thickness: 68 nm) This was further coated with the coating solution for the following low refractive index layer by the bar coater. After having been dried at 70° C., the coating layer was exposed to ultraviolet rays and was cured so as to form a low refractive index layer (refractive index: 1.42; film thickness: 100 nm).

<Preparation of Intermediate Refractive Index Layer/high Refractive Index Layer/low Refractive Index Layer>

(Preparation of Titanium Dioxide Dispersion)

30 parts by weight of titanium dioxide (primary particle weight average particle diameter: 50 nm; refractive index: 2.70), 4.5 parts by weight of anionic diacrylate monomer (PM21 by Nihon Kayaku K.K.), 0.3 parts by weight of cationic methacrylate monomer (DMAEA by KOHJIN Co., Ltd.) and 65.2 parts by weight of methylethylketone were dispersed by a sand grinder to prepare a titanium dioxide dispersion.

(Preparation of Intermediate Refractive Index Layer Coating Solution)

0.14 g of photo-polymerization initiator (Irgacure 907 by Ciba Geigie K.K.) and 0.04 g of photosensitizer (Kayacure DETX by Nihon Kayaku K.K.) were dissolved in 151.9 g of cyclohexane and 37.0 g of methylethylketone. Further, 6.1 g of the aforementioned titanium dioxide dispersion and 2.4 g of the mixture between dipentaerythritol pentaacrylate and dipentaerythritol hexaacrylate (DPHA by Nihon Kayaku K.K.) were added. After having been stirred at room temperature for 30 minutes, the solution was passed through a polypropylene-made filter having an aperture of 0.4 μm to prepare the coating solution for intermediate refractive index layer. The optical film with the hard coat layer formed thereon was coated with this coating solution, and was dried. After having been cured by exposure to ultraviolet rays, the refractive index was measured. The intermediate refractive index layer having a refractive index of 1.72 was obtained.

(Preparation of High Refractive Index Layer Coating Solution)

0.06 g of photo-polymerization initiator (Irgacure 907 by Ciba Geigie K.K.) and 0.02 g of photosensitizer (Kayacure DETX by Nihon Kayaku K.K.) were dissolved in 1152.8 g of cyclohexane and 37.2 g of methylethylketone. Further, the proportion of the titanium dioxide dispersion was increased in the aforementioned titanium dioxide dispersion and the mixture between dipentaerythritol pentaacrylate and dipentaerythritol hexaacrylate (DPHA by Nihon Kayaku K.K.). Adjustment of the amount was made to ensure that the refractive index of the high refractive index layer would be reached. After having been stirred at room temperature for 30 minutes, the solution was passed through a polypropylene-made filter having an aperture of 0.4 μm to prepare the coating solution for high refractive index layer. The optical film with the hard coat layer formed thereon was coated with this coating solution, and was dried. After having been cured by exposure to ultraviolet rays, the refractive index was measured. The high refractive index layer having a refractive index of 1.9 was obtained.

(Preparation of Low Refractive Index Layer Coating Solution)

The following mixture was stirred at room temperature for 20 minutes. The solution was passed through a polypropylene-made filter having an aperture of 0.4 μm to prepare the coating solution for low refractive index layer. This was coated using a bar coater until the drying film thickness would be 0.1 μm (refractive index n=1.42). This was subjected to heat treatment in a 120° C. hot-air dryer for 30 minutes to yield a low refractive index layer having a refractive index of 1.42.

<Low Refractive Index Layer Coating Solution>

Coating medium (solid: 3%) (JN-7215 by JSR K.K.) including the fluorine-containing copolymer (fluoroolefin/vinylether copolymer containing polydimethyl siloxane unit) . . . 30 parts by weight.

Colloidal silica dispersion (average primary particle diameter: 50 nm; solid: 15%; isopropyl alcohol dispersion) . . . 1.5 parts by weight 1-methoxy-2-propanol . . . 6 parts by weight The following describes the method and conditions for removing the contaminants in the Table of FIG. 5 and the timing of removing the contaminants. In the Example 1 (EXAMPLE), contaminants were removed using only the blast material of dry ice. The timing of removing the contaminants is as follows: When the resin film substrate had been coated with the hard coat layer, and curing and formation had completed, the blast material of dry ice was sprayed to the hard coat layer. After removal of the contaminants, the aforementioned antireflection layer was formed on the hard coat layer.

In the Example 2 (EXAMPLE), the blast material of dry ice was sprayed to the hard coat layer. After that, the hard coat layer was further washed by the air type web cleaner. The timing of removing the contaminants is the same as that in the Example 1. After the contaminants had been removed, the aforementioned antireflection layer was formed on the hard coat layer.

In Example 3 (EXAMPLE), the blast material of dry ice and air type web cleaner were used similarly to the case of the Example 2. The timing of removing the contaminants, the blast material of dry ice was sprayed to the resin film substrate prior to formation of the hard coat layer. After formation of the hard coat layer, the blast material of dry ice was sprayed to the hard coat layer. Subsequent to removal of the contaminants, the aforementioned antireflection layer was formed on the hard coat layer.

In Example 4 (EXAMPLE), the blast material of dry ice was sprayed to the hard coat layer. After that, the hard coat layer was further cleaned by the adhesion type web cleaner. The timing of removing the contaminants is the same as that in the Examples 1 and 2. Subsequent to removal of the contaminants, the aforementioned antireflection layer was formed on the hard coat layer.

In Example 5 (EXAMPLE), the blast material of dry ice is sprayed to the hard coat layer. After that, the hard coat layer was further cleaned by the bush type web cleaner. The timing of removing the contaminants is the same as that in Examples 1, 2 and 4. Subsequent to removal of the contaminants, the aforementioned antireflection layer was formed on the hard coat layer.

The conditions E given in FIG. 4(*b*) were used as the conditions for such environment as the temperature in Examples 1-5 (EXAMPLE). To be more specific, the optical film was supported by a roller member having a diameter of 500 mm at a temperature of 30° C. The atmospheric temperature was adjusted to 30° C. and the temperature of the resin film substrate (support member) was also adjusted to 30° C. The atmospheric dew point was set to 0° C. or less. A discharging device was installed to eliminate electric change. The blast material of dry ice was applied to the hard coat layer under the reduced pressure to remove the contaminants.

Comparative Example

The following lists up Comparative examples with reference to EXAMPLE 2:

Comparative example 1: An antireflection layer was formed subsequent to removal of contaminants from the surface of the hard coat layer by the adhesion type web cleaner. Contaminants were removed after the hard coat layer had been formed.

Comparative example 2: An antireflection layer was formed subsequent to removal of contaminants from the surface of the hard coat layer by the brush type web cleaner. Contaminants were removed after the hard coat layer had been formed.

Comparative example 3: The antireflection layer was formed without removing the contaminants from the surface of the hard coat layer surface.

<Inspection of Point Defect and Contaminant Trouble>

A sample (optical film) 100 cm in width and 100 cm in length is taken from the optical film with the aforementioned antireflection layer formed thereon, and was placed on a table. Five 50 W fluorescent lamps were arranged. The fluorescent lamps were secured at a height of 1.5 m from the table so that light was applied at an angle of 45° with respect to the table. The antireflection layer of the sample (optical film) was exposed to the light of these fluorescent lamps to count the point defects (contaminant troubles), having a size of 50 μm or more, that could be observed visually.

In Comparative examples 1-3, the number of contaminants was 30 through 100 per $cm^2$, as shown in the table of FIG. 5. In the Examples 1-5 (EXAMPLE), the number of contaminants was 0-6 per $cm^2$. This indicates that this EXAMPLE ensures sufficient removal of the contaminants.

<Evaluation of Flatness>

A sample (optical film) 90 cm in width and 100 cm in length is taken from the optical film with the aforementioned antireflection layer formed thereon, and was placed on a table. Five 40 W fluorescent lamps (FLR40S-EX-D/M by Matsushita Electric Industries, Co., Ltd.) were arranged. The fluorescent lamps were secured at a height of 1.5 m from the table so that light was applied at an angle of 45° with respect to the table. The antireflection layer of the sample (optical film) was exposed to the light of these fluorescent lamps to check for the presence of the so-called "wrinkles" on the surface of the antireflection layer by visual observation.

A: All five fluorescent lamps appear straight.

B: The fluorescent lamps appear slightly bent in some portion.

C: The fluorescent lamps as a whole appear slightly bent.

D: The fluorescent lamps appear undulating.

As shown in the table of FIG. 5, "A" was registered in the Example 1 through Example 5 (EXAMPLE). By contrast, "D" was marked in Comparative example 1, "C" in Comparative example 2, and "A" in Comparative example 3. This shows that flatness is damaged if contaminants are removed by the adhesion type web cleaner or brush type web cleaner as in Comparative examples 1 and 2. In EXAMPLE of the present invention, by contrast, a satisfactory optical film can be produced without the flatness being adversely affected, when the blast material of dry ice is sprayed to remove the contaminants.

<Evaluation of Scratch Resistance Mark>

100 samples (optical films) measuring 10 cm by 10 cm were produced. A load of 200 $g/cm^2$ was applied to the #0000 steel wool (SW) at a temperature of 23° C. with a relative humidity of 55%, and the surfaces of these samples (optical films) were rubbed 10 times. The number of the scratches for a width of 1 cm having been produced by ten rubbing trials was measured by visual observation. The scratch resistance was measured at 100 positions for each of the samples (optical films). Of the loaded portions, the portion where the scratches were most numerous was used to measure the number of scratches.

A: Less than 3

B: At least 3 and less than 5

C: At least 5 and less than 10

D: At least 10 and less than 15

If the number is less than $10/cm^2$, there is no practical problem. However, the number is preferably less than $5/cm^2$, more preferably less than $3/cm^2$.

As shown in the table of FIG. 5, "A" was registered in Examples 1-5 (EXAMPLE). By contrast, "D" was marked in Comparative examples 1 and 2, and "C" in Comparative example 3. This shows that, in Comparative examples 1-3, variations were observed in the scratch resistance mark, and the optical film surface was more likely to be damaged. In EXAMPLE of the present invention, by contrast, the optical film surface was impervious to damages due to smaller variations in the scratch resistance mark. This ensures a satisfactory optical film to be provided.

The following summarizes the results of evaluation of the aforementioned point defect (contaminant trouble), flatness and scratch resistance mark. It has been revealed that, in Comparative examples 1-3, sufficient removal of the contaminants cannot be achieved and the flatness cannot be maintained. Further, damages are likely to occur due to the variations in scratch resistance mark. EXAMPLE of the present invention, by contrast, reduce the variations in the scratch resistance mark without the flatness of the optical film being adversely affected, and minimizes the risk of causing scratches, whereby sufficient removal of the contaminants is achieved if an antireflection film with the contaminants having been removed by the washing method in EXAMPLE of the present invention is used as the protective film of a polarizing plate, reduction in yield of the polarizing plate resulting from a trouble can be minimized can be minimized, with the result that the yield of the polarizing plate is enhanced. In this manner, EXAMPLE of the present invention provide a satisfactory optical film.

Example 3

The following describes EXAMPLE 3. The aforementioned EXAMPLE 1 was described using an example of using a cellulose triacetate film (TAC film) as the material of the resin film substrate. EXAMPLE 3 will be described with reference to the example wherein the material other than the aforementioned cellulose triacetate film (TAC film) is used as the material of the resin film substrate.

In EXAMPLE 3, for example, the blast material of dry ice was sprayed to the approximately A4-sized resin film substrate, produced by the solution-casting film formation method or melt-casting film formation method, made up of the polycarbonate film (PC film), polyethylene terephthalate, ARTON, ZEONOR or cellulose acrylate film. The blast material of dry ice was sprayed under any one of the condition A through condition I, as in Examples 1-9 shown in FIG. 4. For example, the aspiration nozzle was installed. While suction operation was performed, the blast material of dry ice was sprayed. After that, evaluation of the flatness, and inspection of the contaminant trouble and damages were conducted. As a result, even when the aforementioned material was used, the same effect as that in EXAMPLE 1 was obtained. To be more specific, as compared with Comparative examples 1-3 (prior arts) given in FIG. 4, sufficient removal of the contaminants from the surface can be ensured without the flatness of the resin film substrate being adversely affected or the surface being damaged. As described above, the washing method in EXAMPLE of the present invention provides an optical film of high quality required of a large-screen display, even if the material of the resin film substrate has been changed.

EFFECT OF THE INVENTION

By spraying onto the transparent film surface a solidified blast material via cooling which is a gas or a liquid at normal temperature and pressure, contaminants attached on the transparent film surface can be sufficiently removed via an impact force during spraying as well as a wind pressure caused by a rapid change in temperature and sublimation. No blast material remains on the transparent film surface, since the blast material sprayed onto the transparent film surface sublimes at normal temperature and pressure.

In the present invention, contaminants are not removed by adhesion unlike the case of using an adhesion type web cleaner. The method of the present invention removes the contaminants without deforming the transparent film. To put it more specifically, it removes the contaminants without adversely affecting the flatness of the transparent film. Moreover, unlike the case of using a brush type web cleaner, the present invention does not require the contaminants to be scraped off by force. This arrangement removes the contaminants without damaging the surface of the transparent film. Further, this arrangement provides uniform removal of contaminants, and reduces abrasive spots. As described above, the present invention removes the sufficient amount of contaminants without adversely affecting the flatness of the transparent film or without damaging the transparent film, and hence provides a film of high quality required of a large-screen display.

What is claimed is:

1. A method of manufacturing an optical film, wherein a transparent film is a film formed by coating a curable resin onto a resin film substrate prepared via film formation by solution-casting or melt-casting, to be cured and the method comprises the steps of:

(a) spraying onto at least one surface of the transparent film a solidified blast material via cooling that is a gas or a liquid at normal temperature and pressure;

(b) washing the at least one surface of the transparent film, before coating the curable resin; and (c) coating at least one optically functional layer on the surface of the transparent film that has been washed via step (b).

2. The method of manufacturing an optical film of claim 1, wherein the blast material is sprayed onto the transparent film from an opposite direction with respect to a predetermined direction, when the transparent film is moving in the predetermined direction.

3. The method of manufacturing an optical film of claim 1, wherein the blast material is sprayed in a plurality of separate batches onto the transparent film.

4. The method of manufacturing an optical film of claim 1, wherein a surface temperature of the transparent film is set to 20-120.degree. C. to spray the blast material onto the transparent film.

5. The method of manufacturing an optical film of claim 1, wherein the surface temperature of the transparent film is arranged to a temperature of 20-120.degree. C. via a hot-air blast to the transparent film before spraying the blast material.

6. The method of manufacturing an optical film of claim 1, wherein the surface temperature of the transparent film is maintained at a temperature of 20-120.degree. C. by holding the transparent film on a support member.

7. The method of manufacturing an optical film of claim 1, wherein one surface of the transparent film is held by the support member, and the blast material is sprayed onto the opposite surface of the support member.

8. The method of manufacturing an optical film of claim 7, wherein the support member is composed of a roller member to wind the transparent film, or a belt member on which the transparent film is placed.

9. The method of manufacturing an optical film of claim 1, wherein contaminants removed by spraying after spraying the blast material are aspirated from the periphery of the sprayed portion.

10. The method of manufacturing an optical film of claim 1, wherein the transparent film is discharged by a discharging device.

11. The method of manufacturing an optical film of claim 10, wherein a charging amount of the transparent film immediately after spraying the blast material is arranged to not more than 1 kV by discharging the transparent film with the discharging device.

12. The method of manufacturing an optical film of claim 1, wherein the blast material contains carbon dioxide.

13. The method of manufacturing an optical film of claim 1, wherein the blast material is made of dry ice.

14. The method of manufacturing an optical film of claim 1, wherein the blast material is sprayed onto the optical film under reduced pressure.

15. The method of manufacturing an optical film of claim 1, wherein contaminants on the transparent film are removed employing at least one cleaner of an air type cleaner, an adhesion type cleaner and a brush type cleaner.

16. A method of manufacturing an optical film, wherein a transparent film is a film formed by coating a curable resin onto a resin film substrate prepared via film formation by solution-casting or melt-casting, to be cured, and subsequently wound by a winding roller, and the method comprises the steps of:

(a) spraying onto at least one surface of the transparent film a solidified blast material via cooling that is a gas or a liquid at normal temperature and pressure;

(b) washing the at least one surface of the transparent film, before the winding process after curing the curable resin; and (c) coating at least one optically functional layer on the surface of the transparent film that has been washed via step (b).

* * * * *